United States Patent [19]

Reynolds

[11] Patent Number: 4,542,722

[45] Date of Patent: Sep. 24, 1985

[54] COMBINED ENGINE-STARTER AND ACCESSORY DRIVE SYSTEM

[75] Inventor: Richard W. Reynolds, Rockford, Ill.

[73] Assignee: Sundstrand Corporation, Rockford, Ill.

[21] Appl. No.: 562,962

[22] Filed: Dec. 19, 1983

[51] Int. Cl.[4] ..... F02N 17/00

[52] U.S. Cl. ..... 123/179 E; 123/179 AS; 74/336 R

[58] Field of Search ..... 123/179 E, 179 AS, 179 K; 74/336 R, 336 B, 6; 60/39.141, 39.142, 39.15

[56] References Cited

U.S. PATENT DOCUMENTS

| | | | |
|---|---|---|---|
| 2,055,300 | 9/1936 | Maurer | 74/336 |
| 2,911,961 | 11/1959 | McRae | 74/336 |
| 3,171,252 | 3/1965 | Trowbridge et al. | 60/39.14 |
| 3,416,309 | 12/1968 | Elmes et al. | 60/39.15 |
| 3,481,145 | 12/1969 | Oldfield | 60/39.14 |
| 3,635,019 | 1/1972 | Kronogard et al. | 60/39.15 |
| 3,662,544 | 5/1972 | Kahn et al. | 60/39.14 |
| 3,965,673 | 6/1976 | Friedrich | 60/39.14 |
| 4,043,119 | 8/1977 | Faulkner | 60/39.14 |
| 4,080,843 | 3/1978 | Underwood | 74/336 R |
| 4,257,281 | 3/1981 | Bunger | 74/336 R |
| 4,315,442 | 2/1982 | Cordner | 123/179 AS |

FOREIGN PATENT DOCUMENTS

| | | | |
|---|---|---|---|
| 2838343 | 3/1980 | Fed. Rep. of Germany | 74/336 B |
| 0084854 | 6/1980 | Japan | 74/6 |
| 0028046 | 2/1983 | Japan | 74/336 B |

*Primary Examiner*—Parshotam S. Lall

*Attorney, Agent, or Firm*—Wood, Dalton, Phillips, Mason & Rowe

[57] ABSTRACT

An aircraft secondary power system having a selectively operable power source for drive of accessories and for starting of a jet engine. The system includes a clutch which is engaged when the power source is to start the engine. At a predetermined engine speed, the engine takes over the drive of the accessories through the clutch and, at a selected higher speed of the engine, the clutch is disengaged to cause the drive of the accessories from the engine at a lower drive ratio whereby the accessories are driven at a lower speed relative to the speed of the engine.

7 Claims, 6 Drawing Figures

COMBINED ENGINE-STARTER AND ACCESSORY DRIVE SYSTEM

DESCRIPTION

1. Technical Field

This invention pertains to an aircraft secondary power system and, more particularly, to a combined engine-starter and accessory drive system wherein an auxiliary power unit is selectively operable for the drive of accessories and also can be used for starting of an engine. The drive for the accessories is through two different drive trains having different drive ratios. The accessories are driven by the auxiliary power unit and also by the engine, after start thereof and when at a speed below a shift point, through the drive train having the higher drive ratio. When the engine speed reaches a shift point, a clutch is disengaged to enable drive of the accessories through the drive train having the lower ratio whereby the accessories are driven at a lesser speed relative to the speed of the engine.

2. Background Art

Aircraft secondary power systems and, more particularly, combined engine-starter and accessory drive systems for aircraft are well known in the prior art. One such system is shown in the Faulkner Pat. No. 4,043,119, owned by the assignee of this application. The system has a jet fuel starter which, through suitable components including a torque converter and a starter clutch, operates to drive accessory equipment and is also usable to start the jet engines.

Other prior art systems are shown in accompanying drawings and more particularly described hereinafter. In the foregoing systems, many of the components are large and have high heat rejection because they need to supply their output over a wide range of engine speeds. The prior art has not included an aircraft secondary power system wherein the accessories are driven by the engine in a fixed ratio when the engine is operating at a speed above an idle speed and wherein the fixed ratio may be shifted to a lower ratio as the engine speed increases beyond a shift point to result in a lower speed range for the accessories.

DISCLOSURE OF THE INVENTION

A primary feature of the invention is to provide an aircraft secondary power system for driving accessories and starting an engine from a power source and with the system having means for shifting the drive of the accessories from the power source to a drive from the engine and, when the engine reaches a certain speed, causing the drive of the accessories from the engine at a lower drive ratio. This enables a lowering of the maximum speed at which the accessories are driven and, therefore, reduces the heat rejection from the accessories.

Another feature of the invention is to provide a combined engine-starter and accessory drive system having two drive trains having different drive ratios with one drive train connecting the power source and the accessories and including a disengageable clutch which can be engaged to control the start cycle of the engine from the power source. When the engine is operating at a relatively high speed, the clutch is disengaged to cause a change in the drive of the accessories from said one drive train to the other drive train having the lower drive ratio to reduce the speed range of the accessories relative to the speed range of the engine.

DETAILED DESCRIPTION OF THE PRIOR ART

Figure 1:
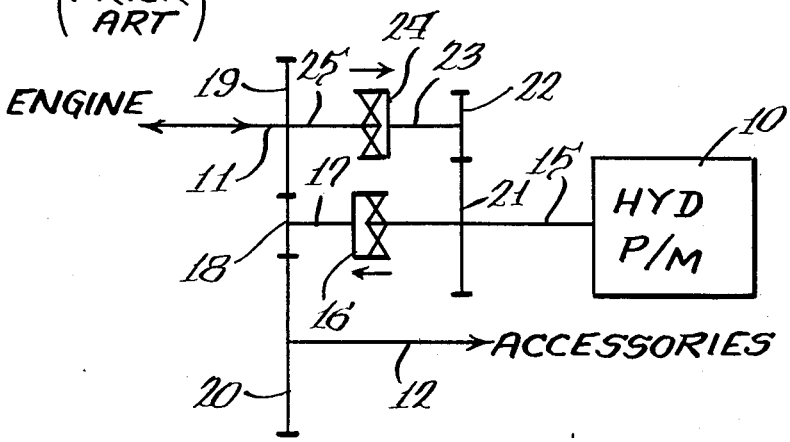
Fig. 1. (PRIOR ART)
FIG. 1 is a schematic view of an aircraft secondary power system known in the prior art.

The gearing of a prior art aircraft secondary power system, as used in the B-70 aircraft, is shown in FIG. 1 and includes a power source 10, an engine drive shaft 11, and an accessory drive shaft 12. The power source 10 is a hydraulic displacement unit which, when supplied with fluid under pressure, operates as a motor and, when driven by the engine, operates as a pump to supply fluid under pressure to one or more devices (not shown). The power source has an output shaft 15 connected to the drive input of an overrunning clutch 16. An output shaft 17 from the overrunning clutch has a gear 18 which meshes with a gear 19 on the engine drive shaft 11 and a gear 20 on the accessory drive shaft 12. In starting the engine, the power source 10 causes rotation of the engine drive shaft 11 and also the accessory drive shaft 12 through the overrunning clutch 16.

A gear 21 on the output shaft 15 meshes with a gear 22 on an output shaft 23 from an overrunning clutch 24 having an input shaft 25 which is connected to the engine drive shaft 11. As noted by the arrows, the overrunning clutch 16 transmits drive from right to left as viewed in the Figure and the overrunning clutch 24 transmits drive from left to right. Once the speed of the engine causes rotation of the gear 18 at a speed faster than that derived from the drive from the power source 10, the drive of the accessories is taken over by the engine and, when the speed of the engine causes the input shaft 25 of the overrunning clutch 24 to rotate faster than the output shaft 23, the engine takes over operation of the power source 10 to have the power source operate as a pump. In this system, the accessories increase in speed in direct relation with the increase in speed of the engine. This system allows the power source 10 to operate as a motor at a high ratio to the engine when starting the engine without causing excessive speed of the power source 10 when acting as a pump and the engine is driving the accessories.

Figure 2:
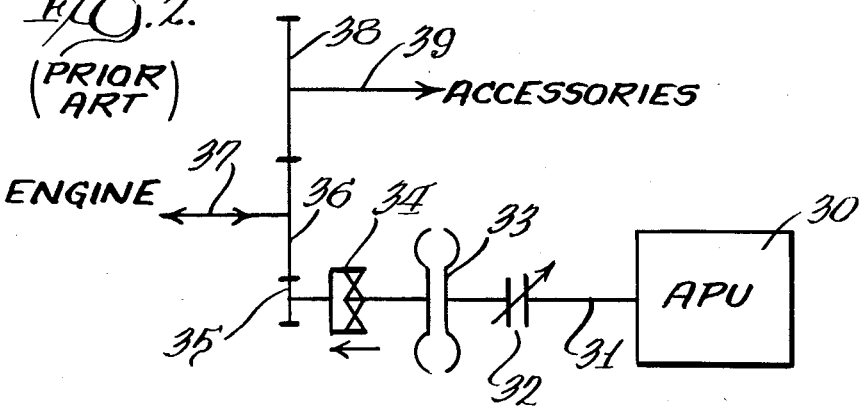
Fig. 2. (PRIOR ART)
FIG. 2 is a schematic view of another aircraft secondary power system known in the prior art.

In the prior art illustrated in FIG. 2, which shows the gearing for an aircraft secondary power system for the F-16 aircraft, a power source 30 is an auxiliary power unit having an output shaft 31 connected to a disengageable slip clutch 32 which connects to the input side of a torque converter 33. The output side of the torque converter connects to an overruning clutch which transmits the drive from right to left, as indicated by the arrow in FIG. 2, for rotation of a gear 35. The gear 35 meshes with the gear 36 on an engine drive shaft 37 and the gear 36 meshes with a gear 38 on an accessory drive shaft 39. Upon start-up of the power source 30 and with engagement of the slip clutch 32, the engine drive shaft 37 is caused to rotate and the accessory drive shaft 39 is driven.

The torque converter amplifies the torque of the auxiliary power unit at low engine speeds and the controllable slip clutch prevents excessive load on the auxiliary power unit when the combination of the torque converter characteristics and the ambient air supply to the auxiliary power unit would cause excessive temperature at the auxiliary power unit turbine if the fuel control tries to maintain auxiliary power unit speed. At a selected engine speed, the slip clutch 32 can be disengaged, with the accessories then being driven from the engine and with the overrunning clutch 34 preventing drive of the torque converter from the engine.

BEST MODES FOR CARRYING OUT THE INVENTION

Figure 3:
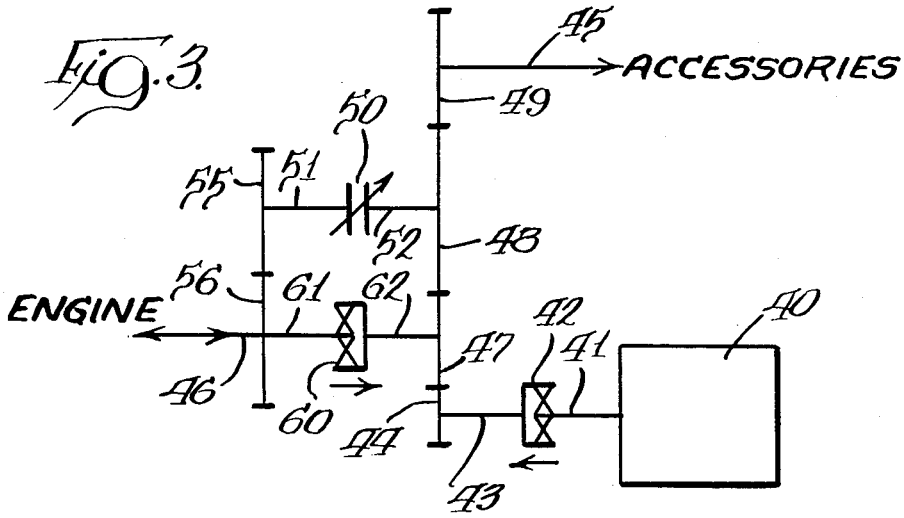
FIG. 3 is a schematic view of one embodiment of the aircraft secondary power system.

A first embodiment of the invention is shown in FIG. 3 wherein a power source 40 is an air turbine starter or free turbine auxiliary power unit and has an output shaft 41 connected to an overrunning clutch which transmits drive from the power source to a shaft 43, in the direction indicated by the arrow. The output shaft 41 is operable to drive an accessory drive shaft 45 and an engine drive shaft 46. A first drive train for driving the accessory drive shaft 45 from the power source includes the output shaft 41, the overrunning clutch 42, and the shaft 43 as well as a gear 44 carried on the latter shaft which meshes with a gear 47. The gear 47 meshes with a gear 48 which meshes with a gear 49 on the accessory drive shaft 45.

Parts of the first drive train are also used for starting of the engine by rotation of the engine drive shaft 46. Engine start-up is initiated by closing a disengageable slip clutch 50 having shafts 51 and 52 extending therefrom, with the shaft 52 mounting the previously-mentioned gear 48 and the shaft 51 mounting a gear 55 which meshes with a gear 56 on the engine drive shaft 46. The first drive train has gears of selected diameters whereby rotation of the output shaft 41 of the power source 40 will cause rotation of the accessory drive shaft 45 and the engine drive shaft 46 at a lower speed. The engine can be started by the power source 40 without the use of a torque converter utilized in the other embodiments to be described because the power source is an air turbine starter or free turbine auxiliary power unit which gives you the proper torque-speed characteristics.

The slip clutch 50 remains engaged until the engine reaches a certain speed above engine idle speed. When a shift point is reached, the slip clutch 50 is disengaged and the accessory drive shaft 45 is driven from the engine drive shaft 46 through a second drive train having a lower drive ratio than the first drive train. The second drive train has gears which, in part, are common to the first drive train including the gears 47, 48 and 49 and includes an overrunning clutch 60 connected to shafts 61 and 62 fixed to the gears 56 and 45, respectively, and which transmits a drive from left to right, as viewed in the Figure and as indicated by the arrow. With the disengagement of the slip clutch 50 at the shift point, the drive to the accessories is through the overrunning clutch 60 and with a lower drive ratio whereby the accessory drive shaft 45 rotates at a speed less than that which would occur if the slip clutch were still engaged.

Figure 6:
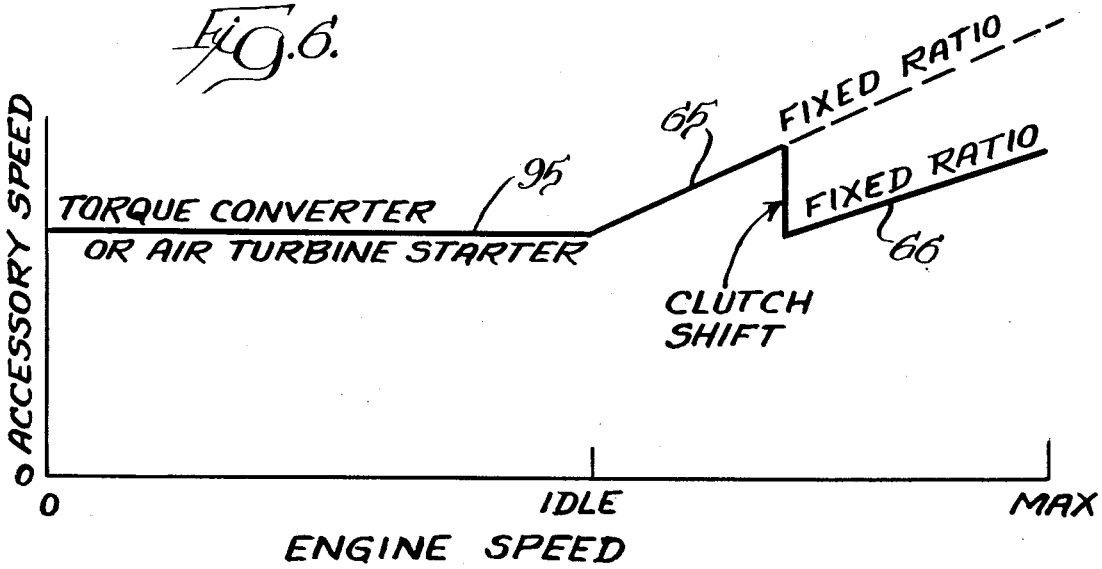
FIG. 6 is a graph illustrating the relation between accessory and engine speeds achieved by the embodiments of the invention.

This operation is illustrated in the graph of FIG. 6, plotting accessory speed against engine speed and which shows the accessory speed remaining relatively constant as driven by the power source 40. When the engine speed exceeds an idle speed, the accessory speed increases in a fixed ratio to engine speed, as indicated by the sloped line 65. The engine is driving the accessories through the slip clutch 50 and the first drive train. At the shift point, identified as clutch shift, the slip clutch 50 is disengaged and the drive of the accessories is at a lower ratio through the second drive train. The accessory speed is indicated by the sloped line 66 as the engine speed increases beyond the shift point. As a result, the accessories are not required to operate at as high a speed as the engine operates at higher speeds.

The drive of the accessories from the engine through the slip clutch 50 is at a higher ratio than the drive through the overrunning clutch 60. The slip clutch 50, in addition to controlling the startup of the engine from the power source 40, also determines the shift point by being disengaged. The slip clutch may be of a type well known in the art which has interengaging plates and can be hydraulically actuated between open and closed conditions and which, when the engine is operating at high speed, reduces the power requirements of the power source.

The gear diameters in the two drive trains are selected appropriately to provide the different drive ratios.

The disengageable slip clutch 50 defines a first disengageable connection between the gears 48 and 56 which are common to both the first drive train and the second drive train and the overrunning clutch 60 defines a second disengageable connection between the engine drive shaft 46 and the common gears 48 and 56.

Figure 4:
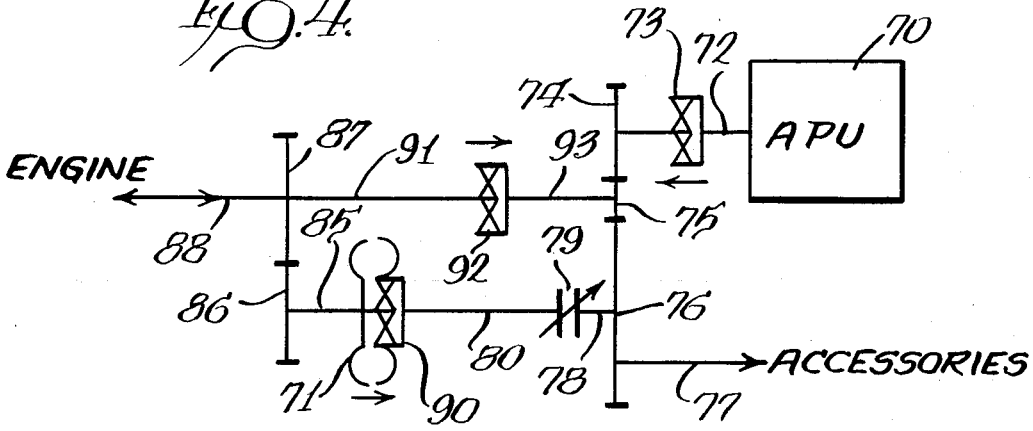
FIG. 4 is a schematic view of a second embodiment of the aircraft secondary power system.

A second embodiment of the invention is shown in FIG. 4 wherein a power source 70 is an auxiliary power unit of the fixed shaft type and the system utilizes a torque converter 71 to amplify the torque of the power source at low engine speeds. In this embodiment, an output shaft 72 from the power source connects to an overrunning clutch 73 which transmits rotation to a gear 74 of a first drive train which further includes a gear 75 meshing with the gear 74 and a gear 76 meshing with the gear 75. An accessory drive shaft 77 is connected to the gear 76 and the gear 76 has a shaft 78 which connects to a disengageable slip clutch 79 which, by a shaft 80, is connected to one side of the torque converter 71. The torque converter also connects to a shaft 85 carrying a gear 86 which meshes with a gear 87 on the engine drive shaft 88. The power source 70 can drive the accessory drive shaft 77 through the first drive train and, when the engine is to be started, the slip clutch 79 is engaged and the drive from the power source is transmitted to the engine drive shaft 88 through the torque converter 71 which are also in the first drive train. The torque converter 71 has an overrunning clutch 90 associated therewith which transmits a drive from the engine drive shaft 88 from left to right as shown by the arrow in the Figure to drive the accessory drive shaft 77 through the slip clutch 79 when it is engaged and when engine speed causes gear 76 to rotate at a speed greater than that caused by the drive from the power source.

The engine drive shaft 88 connects to a shaft 91 which connects to an overrunning clutch 92 in a second drive train having a connection to a shaft 93 which mounts the gear 75 and which transmits a drive from left to right, as indicated by the arrow. The selection of gear diameters is such that the first drive train to the engine drive shaft 88 through the slip clutch 79 has a higher drive ratio than the drive ratio of the second gear train extending from the engine drive shaft through the overrunning clutch 92 to the accessory drive shaft 77.

After engine start and up to a shift point when engine speed is in excess of an idle speed, the drive of the accessory drive shaft 77 is through the overrunning clutch 90 and the slip clutch 79 and, when the shift point is reached, the slip clutch 79 is disengaged whereby the accessory drive shaft is driven through the second drive train including the overrunning clutch 92 to drive the accessory shaft at a lower drive ratio and, thus, have the accessory drive shaft operate in a fixed ratio of speed to the speed of the engine, but which is less than with the slip clutch 79 engaged.

This operation is illustrated in FIG. 6 wherein the accessory speed is constant, as indicated by the line 95, while engine speed is increasing by the drive through the first drive train including the torque converter 71. At idle speed, the engine takes over drive of the accessory drive shaft 77, as indicated by the sloped line 65, and when the slip clutch 79 is disengaged, the accessory drive shaft is driven at a lower fixed ratio, as indicated by the sloped line 66.

Figure 5:
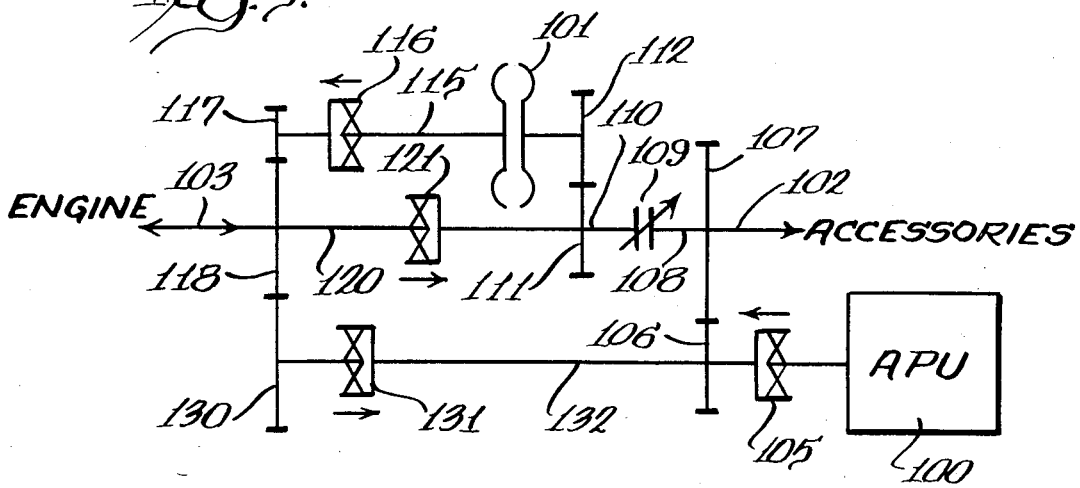
FIG. 5 is a schematic view of a third embodiment of the aircraft secondary power system.

A third embodiment of the invention is shown in FIG. 5 which can be used if the low engine speed accessory requirements and the engine starting requirements are such that a higher ratio is required for engine starting. In this embodiment, the power source 100 is an auxiliary power unit of the fixed shaft type and, thus, the system utilizes a torque converter 101. The power source 100 drives an accessory drive shaft 102 and an engine drive shaft 103 through an overrunning clutch 105 which transmits drive from right to left as shown by the arrow to a first drive train.

The first drive train includes a gear 106 which meshes with a gear 107 operatively connected to the accessory drive shaft 102 and to a shaft 108 connected to a disengageable slip clutch 109. A clutch shaft 110 carries a gear 111 which meshes with a gear 112 connected to the torque converter 101. A shaft 115 connects the torque converter 101 to an overrunning clutch 116 which transmits drive from right to left as viewed in the Figure and as indicated by the arrow for drive of a gear 117 which meshes with a gear 118 operatively connected to the engine drive shaft 103. The power source 100 can drive the accessory drive shaft 102 and the engine drive shaft 103 through the first drive train drive.

The engine drive shaft 103 connects to a shaft 120 connected to an overrunning clutch 121 which transmits a drive from left to right, as viewed in the Figure and as indicated by the arrow, and which connects to the gear 111. When the engine reaches idle speed, the accessory drive shaft 102 is driven from the engine through the slip clutch 109. When the engine speed reaches the previously-mentioned shift point, the slip clutch 109 is disengaged and the drive of the accessory drive shaft 102 is through a second drive train. The second drive train includes the gears 107 and 118 as well as a gear 130 which meshes with the gear 118 and connects to an overrunning clutch 131 which transmits the drive from left to right as viewed in the Figure, and as indicated by the arrow, for driving of a shaft 132 which carries the gear 106. The overruning clutch 116 allows the torque converter to run with minimum losses when the engine is driving the accessories.

In all of the embodiments, the diameters of the gears in the drive trains are related to each other whereby the second drive train which drives the accessory drive shaft from the engine drive shaft after disengagement of the slip clutch has a lower drive ratio than the first drive train. This results in engine starting and low speed engine operation being accomplished at a high drive ratio with the slip clutch engaged. In high speed engine operation, the accessory drive shaft operates at a fixed speed ratio to speed of the engine, but at a lesser speed and therefore does not have to operate over as wide a speed range.

I claim:

1. A combined engine-starter and accessory drive system comprising, a power source with an output shaft, an accessory drive shaft, a series of meshing gears and an overrunning clutch interconnecting said shafts whereby rotation of said output shaft rotates said accessory drive shaft, an engine drive shaft, intermeshing gears one of which is connected to said engine drive shaft, a drive connection between the other of said intermeshing gears and one of said series of meshing gears and including a disengageable slip clutch, and another drive connection between the engine drive shaft and said series of meshing gears in parallel drive relation with the first-mentioned drive connection and including an overrunning clutch operable to transmit rotation only from the engine drive shaft to said series of meshing gears.

2. A combined engine-starter and accessory drive system as defined in claim 1 wherein said drive connection between the other of said intermeshing gears and one of said series of meshing gears includes a torque converter for amplifying the torque of the power source.

3. A combined engine-starter and accessory drive system as defined in claim 2 including a drive connection from the engine drive shaft to the input side of the torque converter and including an overrunning clutch to lock up the torque converter when the engine speed attempts to go above the torque converter input speed.

4. A combined engine-starter and accessory drive system comprising, a power source with an output shaft, an accessory drive shaft, a drive train including a series of meshing gears and an overrunning clutch interconnecting said shafts whereby rotation of said output shaft rotates said accessory drive shaft, an engine drive shaft, intermeshing gears one of which is connected to said engine drive shaft, a drive connection between the other of said intermeshing gears and one of said series of meshing gears and including a disengageable clutch and a torque converter for drive of the engine drive shaft from the power source when the disengageable clutch is engaged, and another drive connection between the engine drive shaft and said series of meshing gears in parallel drive relation with the first-mentioned drive connection and including an overrunning clutch operable to transmit rotation only from the engine drive shaft to said series of meshing gears.

5. A combined engine-starter and accessory drive system comprising, a power source with an output shaft, an accessory drive shaft, a drive train including a series of meshing gears and an overrunning clutch interconnecting said shafts whereby rotation of said output shaft rotates said accessory drive shaft, an engine drive shaft, intermeshing gears one of which is connected to said engine drive shaft, a drive connection between the other of said intermeshing gears and one of said series of meshing gears and including a disengageable clutch and a torque converter for drive of the engine drive shaft from the power source when the disengageable clutch is engaged, a second drive connection between the engine drive shaft and said meshing gears through said disengageable clutch and including an overrunning clutch and operable to transmit rotation to the accessory drive shaft, and a further drive connection between the engine drive shaft and said series of meshing gears including an overrunning clutch operable to transmit rotation only from the engine drive shaft to said series of meshing gears when said disengageable clutch is disengaged.

6. A combined engine-starter and accessory drive system comprising: a power source with an output shaft; an accessory drive shaft; a first drive train including gears and an overrunning clutch connecting said output shaft and the accessory drive shaft, an engine having an engine drive shaft; means for transmitting the drive from the output shaft to the engine drive shaft to start the engine including a disengageable slip clutch connected to the first drive train and connected to drive transmission components including a torque converter and an overrunning clutch which transmits a drive from the torque converter to the engine drive shaft; means including an overrunning clutch connecting the engine drive shaft to said first drive train through said slip clutch and to the input side of the torque converter for driving the accessory drive shaft from the engine drive shaft at a certain drive ratio when the engine reaches a predetermined speed; and means including an overrunning clutch connecting the engine drive shaft to said first drive train for driving the accessory drive shaft from the engine drive shaft at a lower drive ratio when the engine reaches a speed higher than said predetermined speed and the slip clutch is disengaged.

7. An aircraft secondary power system providing for engine start and accessory drive comprising, an engine drive shaft, an accessory drive shaft, a power drive shaft connectable to a power source, first gear means interconnecting said power drive shaft and said accessory drive shaft for driving of accessories from said power drive shaft and including an overrunning clutch to prevent a reverse drive to the power drive shaft, second gear means interconnecting said first gear means with the engine drive shaft and including a disengageable slip clutch, third gear means interconnecting said engine drive shaft with the first gear means in parallel drive relation with the second gear means and including an overrunning clutch to transmit a drive only from the engine drive shaft and permit drive of the accessories from the engine drive shaft by the second gear means when the slip clutch is engaged, and said third gear means having a different drive ratio than the second gear means to achieve a lower ratio between the engine drive shaft and the accessory drive shaft when the slip clutch is disengaged.

* * * * *